United States Patent [19]

Khanna

[11] Patent Number: 4,691,363

[45] Date of Patent: Sep. 1, 1987

[54] TRANSDUCER DEVICE

[75] Inventor: Satya P. Khanna, Indianapolis, Ind.

[73] Assignee: American Telephone & Telegraph Company, AT&T Information Systems Inc., Murray Hill, N.J.

[21] Appl. No.: 807,636

[22] Filed: Dec. 11, 1985

[51] Int. Cl.[4] ..... H04R 19/01

[52] U.S. Cl. ..... 381/205; 381/191; 381/188; 381/87

[58] Field of Search ..... 381/91, 87, 113, 88, 381/205, 188, 191; 179/146 E, 111 E; 361/421, 403, 400, 405

[56] References Cited

U.S. PATENT DOCUMENTS

| | | | |
|---|---|---|---|
| 4,509,193 | 4/1985 | Carlson | 381/113 |
| 4,533,795 | 8/1985 | Baumhauer, Jr. | 179/111 E |
| 4,539,621 | 9/1985 | Currier | 361/405 |
| 4,542,264 | 9/1985 | Schmidt | 179/111 E |
| 4,559,418 | 12/1985 | Imai | 381/113 |
| 4,571,464 | 2/1986 | Segerö | 179/111 E |
| 4,584,702 | 4/1986 | Walker, Jr. | 381/91 |

FOREIGN PATENT DOCUMENTS

| | | | |
|---|---|---|---|
| 0136270 | 4/1985 | European Pat. Off. | 381/113 |

OTHER PUBLICATIONS

Björklund, et al., "Custom Design Circuits for Telecommunications," *Ericsson Review*, vol. 57, No. 4, 1980.

*Primary Examiner*—Gene Z. Rubinson
*Assistant Examiner*—L. C. Schroeder
*Attorney, Agent, or Firm*—R. F. Kip, Jr.

[57] ABSTRACT

A silicon micro-transmitter chip is housed within top and bottom closures snap-fitted together by legs and catches on the two closures. The chip is mounted between two acoustic cavities in the closures by a plate part of a configured metal sheet having other strip parts extending through grooves in the bottom closure to its outside where the strips are bent to provide arms for surface mounting the entire device on a printed wiring board. The sheet serves both as a continuous strap for effecting such surface mounting and as an electrode for connecting a terminal of the chip to ground. Other terminals of the chip are connectable to the board by flat leads passing through other grooves in the bottom closure to its outside where they are bent for surface mounting purposes. The housing formed by the two closures includes an adhesive impregnated gasket for providing an acoustic seal between the two cavities as to which the air pressures therein are equalized by a vent hole in the plate.

17 Claims, 6 Drawing Figures

TRANSDUCER DEVICE

FIELD OF INVENTION

This invention relates generally to acoustoelectric transducer devices and, more particularly, to devices of such kind in which the transducer is a silicon micro-transmitter chip.

BACKGROUND OF THE INVENTION

U.S. Pat. 4,492,825 issued Jan. 8, 1985 in the name of Brzezinski et al and assigned to AT&T Bell Laboratories discloses a transducer device in which conversion between acoustic waves and corresponding electrical signals is effected by an electret microphone. The device comprises a metallic backplate, an inner dielectric housing member molded about the perimeter of the backplate to extend in its thickness dimension to either transverse side thereof, and having openings on both such sides which are coextensive with the expanse of the backplate inside its perimeter, an outer electroconductive housing member molded about such inner member to either transverse side thereof and having openings registering with the openings in such inner member, an electret diaphragm received in one of such openings and spaced from the backplate by an annular spacer so as to cooperate with the backplate to form an electret microphone, a pair of covers received in the outer ends of the openings on opposite sides of such microphone to provide acoustic cavities therefor on such opposite sides, and conductor means partly molded into and partly extending from the inner housing and providing for connection to the exterior of the device of the microphone and certain other electrical components in the device. In the transducer device just described, the housing therefor is inseparable, fabrication of the device requires assembly of a relatively large number of parts, and the device is not adapted for surface mounting on a printed wiring board.

SUMMARY OF THE INVENTION

In contrast to the foregoing, a transducer device according to the invention hereof in one of its aspects comprises a micro-transmitter chip, a housing for said chip comprising two insulative closures having their front ends in registration at an interface and having respective acoustic cavities extending thereinto from their front ends, chip mounting means mounting such chip in the interface region as as to be between such cavities, and closure-coupling means comprising parts integral with respective ones of such two closures and snap-fittable together to releasably lock such closures together.

According to the invention hereof in another of its aspects, the transducer device comprises a microtransmitter chip, a hollow housing having aperturing from the inside to the outside of said housing, and metallic sheet means extending through such aperturing so as to have parts inside and outside the housing, the inside part mounting the chip in the housing to be between two acoustic cavities therein, and the sheet means outside the housing being bondable to metallic material on a printed wiring board. The mentioned sheet means is thus adapted to perform the several functions of mechanically effecting or contributing to surface mounting of such device on such board, providing an electrical ground plane for the chip and serving as conductor means for electrically connecting the chip circuitry to the exterior of the device.

BRIEF DESCRIPTION OF THE DRAWINGS

For a better understanding of the invention, reference is made to the following description of an exemplary embodiment thereof, and to the accompanying drawings wherein.

DETAILED DESCRIPTION OF EMBODIMENT

Figure 1:
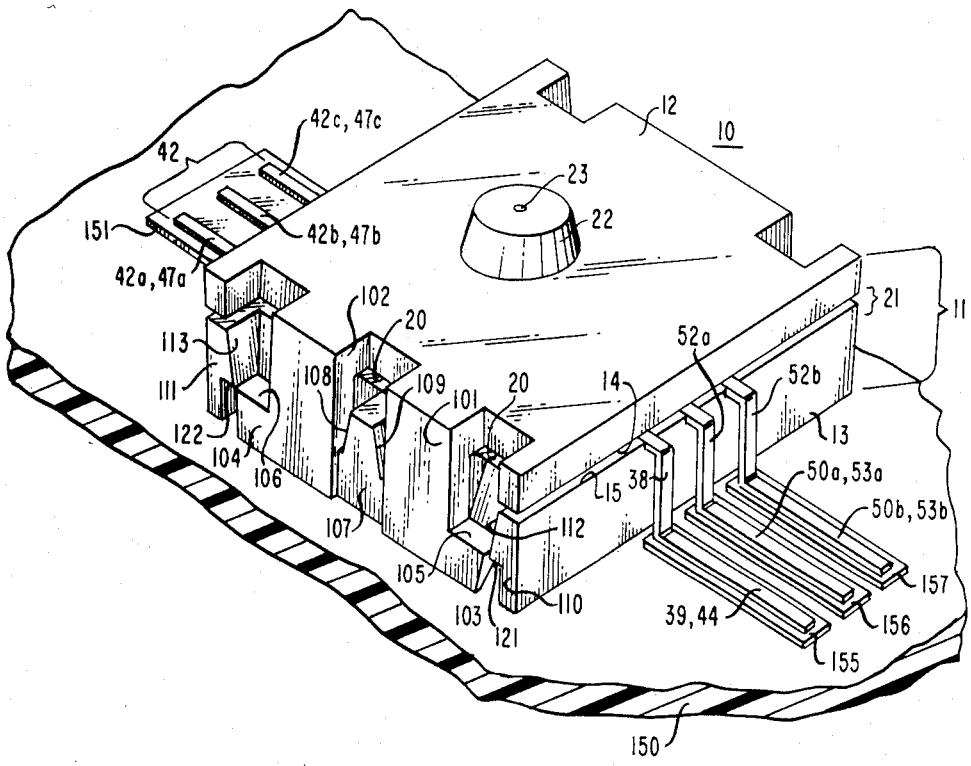
FIG. 1 is an isometric view of an exemplary transducer device according to the invention.

Referring now to FIG. 1, the reference number 10 generally designates a transducer device having a hollow housing 11 comprising traversely displaced top and bottom insulative closures 12 and 13 having their respective front ends 14 and 15 in registration at an interface 20 between them in a transversely central region 21 of housing 11. Closure 12 has on its top a sound port 22 with a passage 23 formed therein and extending transversely downward to the hollow interior of such closure. Passage 23 permits voice sound waves or other acoustic waves to reach an acoustic cavity 24 (FIG. 6) formed in closure 12 and extending rearwardly thereinto from its front end 14. Bottom closure 13 has formed therein a similar acoustic cavity 25 extending rearwardly thereinto from its front end 15 and disposed opposite cavity 24. Cavities 24 and 25 are each of rectangular parallelepiped form but are somewhat differently dimensioned.

Figure 6:
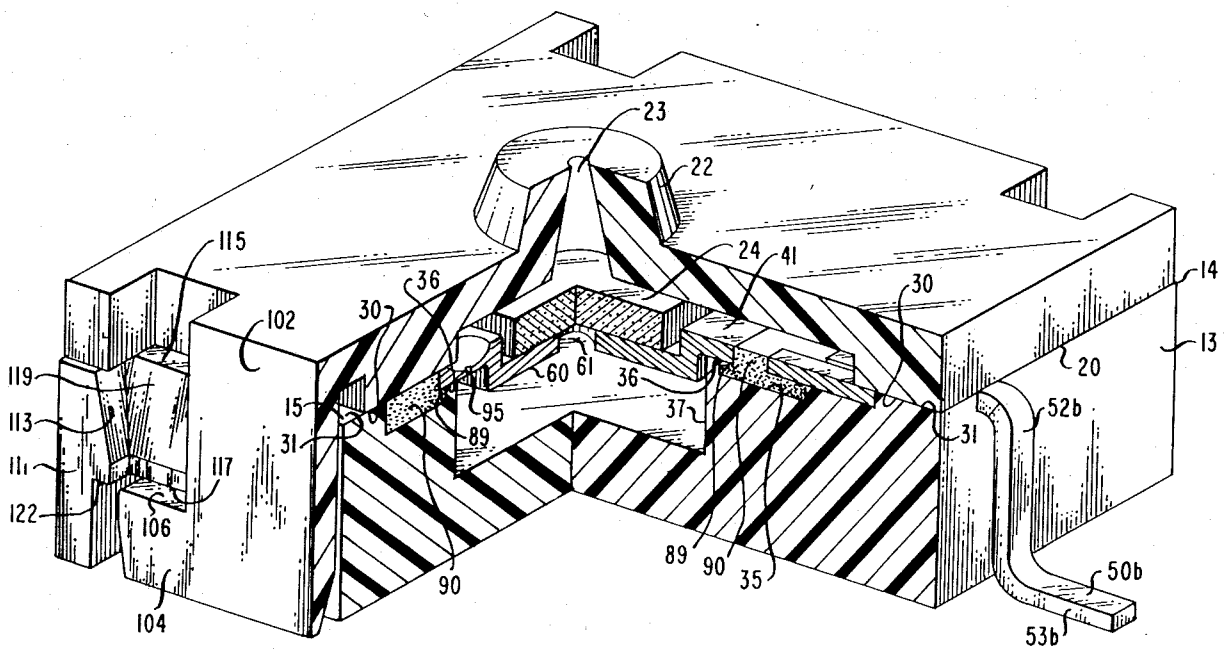
FIG. 6 is a partial cross-sectional view of the FIG. 1 device taken in two cross-sectional planes normal to each other to cut-away the right-hand front quadrant of such device.

As shown in FIG. 6, closure 12 has at its front end an end surface 30 extending around the cavity 24 in that closure. Similarly, closure 13 has at its front end an end surface 31 extending around the cavity 25 in the latter closure. Surfaces 30 and 31 are planar surfaces in flush engagement with each other, the interface 20 being provided by the discontinuity between such engaging surfaces.

Bottom closure 13 has formed in its interior a gasket seat 35 in the form of a channel of rectangular ring shape (FIG. 4) in the lateral-longitudinal (i.e., horizontal) plane. Seat 35 is disposed in such plane between end surface 31 and a raised rectangular lip 36 surrounding the front-end opening of acoustic cavity 25. Lip 36 has a top at a lower level than surface 31. In the lateral-transverse and longitudinal-traverse vertical planes, gasket seat channel 35 is of rectangular "U" cross section with the arm of the "U" which connects to end surface 31 being longer than the arm of the "U" which connects to the top of lip 36.

Seated on lip 36 is a plate 41 which is an integral part of a metallic sheet 40 having as another integral part an extension 42 from plate 41 (FIG. 4) passing from the inside to the outside of housing 11 through aperturing 43 formed in the end surface 31 of closure 13 on one longitudinal side of the housing to permit such passage. While the extension 42 and the grooving 43 may be continuous over the lateral extent occupied thereby, that extension may conveniently be divided into three flat metallic strips 42*a*, 42*b*, 42*c*, the aperturing 43 being consonantly divided into three grooves 43*a*, 43*b*, 43*c*. Each of those grooves upon assembly of device 10, receives a respective one of those strips so that separate parts of each such strip are, respectively, inside and outside of housing 11. In the assembled device 10, the outside parts of leads 42*a*, 42*b*, 42*c* each has formed therein an "L" or "gull wing" bend so that the outside parts of such leads comprise respective downwardly extending upper arm-portions 46*a*, 46*b*, 46*c* and respective lower arm portions 47*a*, 47*b*, 47*c* extending outwardly from housing 11.

Another integral part of sheet 40 is an extension from plate 41 in the form of a flat metal lead 44 joined at one end to plate 41 and stretching away from it in the longitudinal direction opposite to that taken by strips 43*a*, 43*b*, 43*c*. Upon assembly of device 10, lead 44 is received in aperturing in housing 11 in the form of a groove 46 formed in end surface 31 on the longitudinal side of housing opposite aperturing 43. When lead 44 is received in groove 46, separate parts of the lead are disposed inside and outside of the housing 11.

In the assembled device 10, the outside part of lead 44 has formed therein an "L" or "gull wing" bend so as to comprise (FIG. 1) a downwardly extending upper arm portion 38 and a lower arm portion 39 extending outwardly from housing 11. The underside of outwardly extending arm portion 39 is substantially co-planar with the bottom of housing 11.

Figure 2:
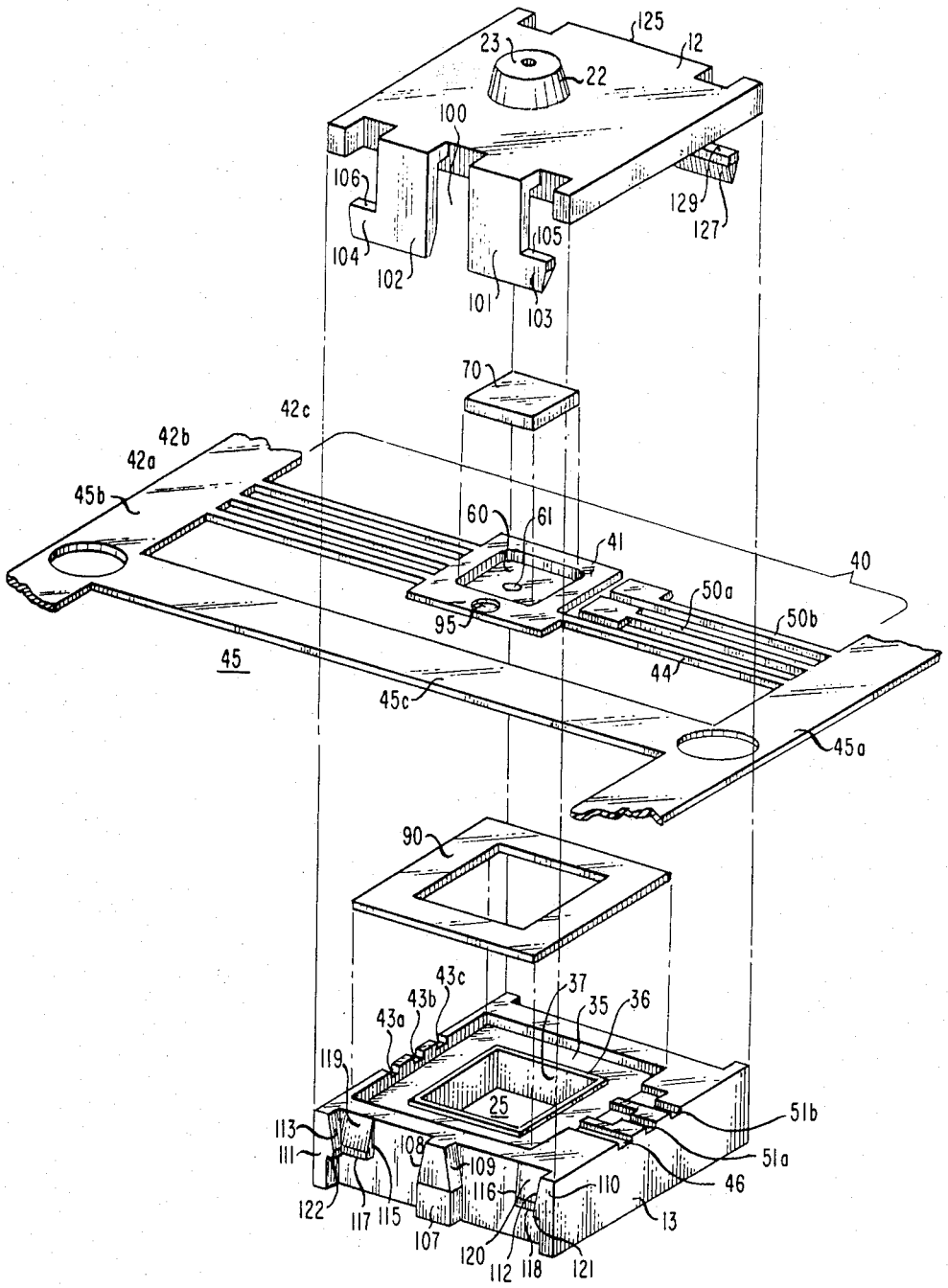
FIG. 2 is an exploded view of components of the FIG. 1 device prior to the assembling of such components to form such device.

In the course of manufacture of device 10, sheet 40 may conveniently be initially (FIG. 2) in the form of a stamping made in stock in the form of a sheet metal strip 45 having a succession of identical ones of such stampings made therealong so that each such stamping is supported between two outside carrier strips 45*a* and 45*b* coupled together by a succession of cross-wise webs 45*c* alternating with the sheet stampings 40. In FIG. 2, the stock strip 45 is broken away to show only one sheet 40 and one web 45*c* and only portions of the outside carrier strips 45*a* and 45*b*. The structure formed by two adjacent ones of such crosswise webs 45*c*, the portions between them of carrier strips 45*a*, 45*b* and the stamped configurations included within the rectangle thus formed is often referred to as a "lead frame".

Included in the lead frame partly shown in FIG. 2 is metallic strip means 50 which, upon assembly of device 10, passes from the outside of housing 11 to its inside through aperturing 51 formed in the end surface 31 of bottom closure 13 on the longitudinal side of the housing away from aperturing 43. When used for electrical purposes (as opposed to solely mechanical purposes), strip means 50 comprises two laterally spaced electrical leads 50*a* and 50*b* and aperturing 51 comprises two grooves 51*a* and 51*b* for respectively receiving those leads. Prior to assembly of device 10, leads 50*a*, 50*b* are supported in the mentioned lead frame as cantilevers from carrier strip 45*a*. After such assembly, those leads 50*a*, 50*b* are respectively received in their corresponding grooves 51*a*, 51*b* so that each such lead has separate parts which are, respectively, inside and outside the housing 11.

Figure 4:
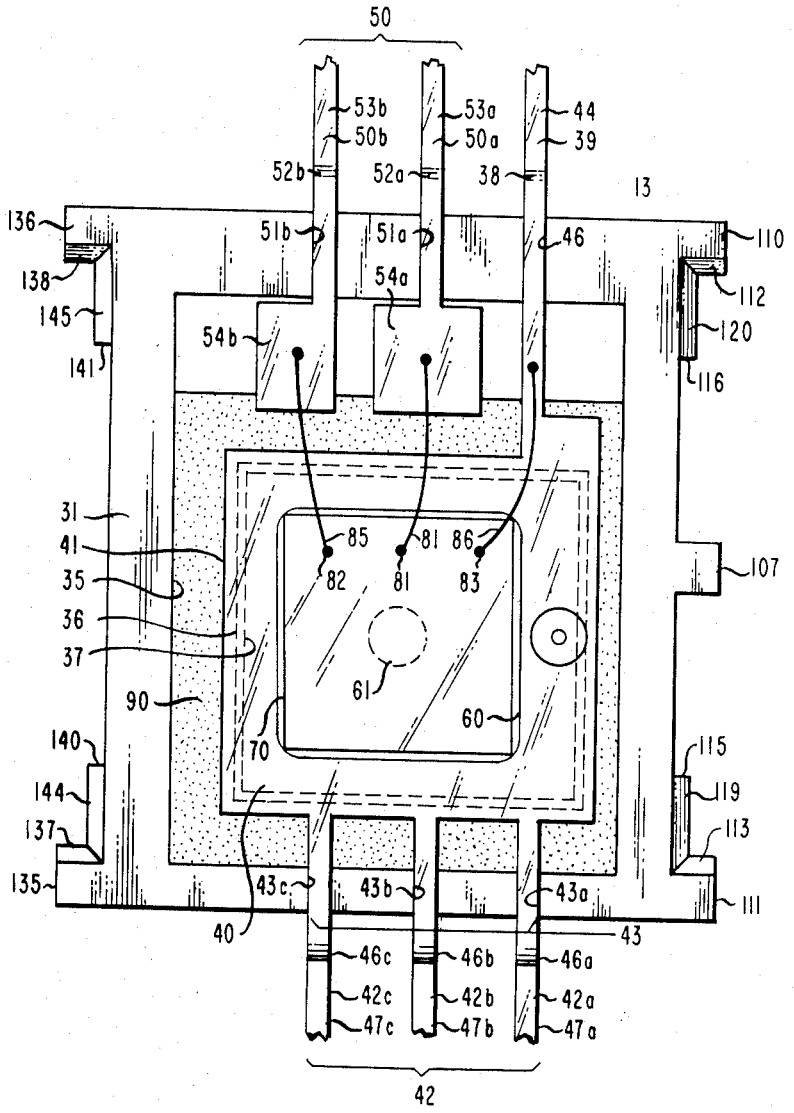
FIG. 4 is a plan view of the lower half of the FIG. 1 device when the top closure thereof has been removed.

In the assembled device 10, outside parts of leads 50*a* and 50*b* each have an "L" or "gull wing" bend so that such parts respectively comprise downwardly extending upper arm portions 52*a*, 52*b* and lower arm portions 53*a*, 53*b* extending outwardly from housing 11. The undersides of those lower arms are substantially co-planar with the underside of lower arm portion 39 of lead 44 and with the bottom of housing 11. At their inner ends, the leads 50*a*, 50*b* have respective enlarged heads 54*a*, 54*b* (FIG. 4).

The stock strip 45 (including all its parts) is constituted of a relatively pliable electroconductive metal or metal alloy as, for example but without restriction, copper, bronze or brass.

Returning to the plate 41 (FIGS. 2, 4 and 6), that plate is dished to form centrally therein a shallow rectangular flat-bottomed indentation or concavity 60. Concavity 60 has formed in the bottom thereof a hole 61 passing downwardly through plate 40 to communicate in the assembled device 10 with the acoustic cavity 25 in the bottom closure 13.

Concavity 60 provides a seat for a silicon micro-transmitter chip 70 adhesively bonded in the assembled device 10 to the bottom surface of concavity 60 so as to be over hole 61. Such adhesive bonding is effected by a layer 62 (FIG. 3) of epoxy resin deposited on and covering the bottom surface of such concavity and surrounding that hole.

Figure 3:
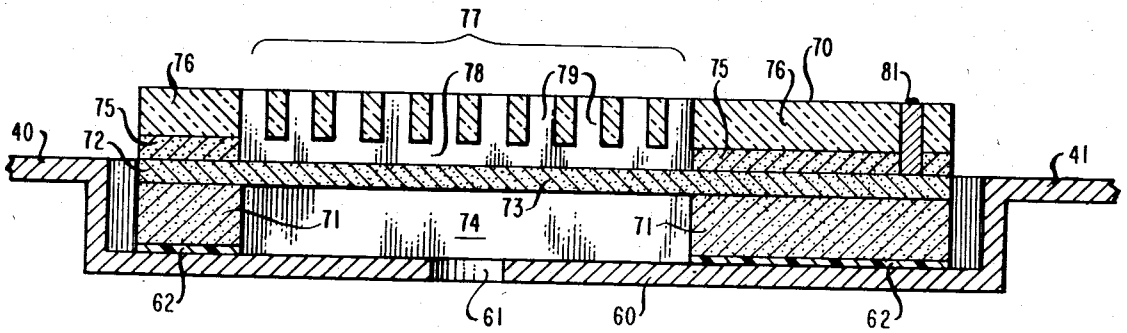
FIG. 3 is a fragmentary enlarged front elevation in cross-section of the micro-transmitter chip component of the FIG. 1 device and its surroundings when such chip is in place in such device.

Chip 70 has similarities in structure and circuitry to the semiconductive micro-transmitter disclosed in U.S. patent application Ser. No. 511,640 filed July 7, 1983 in the name of J. C. Baumhauer, Jr., H. J. Hershey and T. L. Poteat for "Integrated Electroacoustic Transducer" and assigned in part to AT&T Bell Laboratories a subsidiary of American Telephone and Telegraph Company of which the assignee hereof is also a subsidiary. Such U.S. patent application is by this reference incorporated herein and made a part hereof. Details of the chip are shown in FIG. 3 and will now be described.

Chip 70 comprises a silicon semiconductor substrate 71 on which is deposited a monocrystalline silicon epitaxial layer 72 of which part forms a vibratable diaphragm 73 bounded on its lower side by a cavity 74 etch-formed in substrate 71. Formed on layer 72 is a spacer layer 75 which is constituted of, say, polycrystalline silicon and which has an opening therein over the top of diaphragm 73. Formed on layer 75 is an insulative layer 76 which is constituted of, say, silicon nitride, and of which a part bridges the mentioned opening to form a backplate 77 vertically spaced from diaphragm 73 by an air gap 78 and having therein an array of vertical air holes 79. The top of diaphragm 73 and the bottom of backplate 77 have thereon respective metallized layers connected by respective conductor means to electronics fabricated in or on substrate 71 at its right hand side, none of such layers, conductor means and electronics being shown in FIG. 3. The air-gap spaced metallized elements 73 and 77 form a miniaturized capacitive microtransmitter or microphone. The mentioned electronics is connectable to circuitry external thereto by two active terminals 81, 82 on the top of chip 70 (FIG. 4) and by a ground terminal 83 also on the top of such chip. In device 10, terminals 81 and 82 are connected by, respectively, wire conductors 84 and 85 to, respectively, leads 50*a* and 50*b*, while terminal 83 is connected by wire conductor 86 to lead 44.

Plate 41 is greater in size than the lip 36 on which it rests so that the peripheral outer edge 89 (FIG. 6) of the plate juts slightly outward of that lip on all four sides of the plate. Associated with plate 41 is a resiliently compressible gasket 90 seated in the aforedescribed gasket seat 35. As shown (FIG. 2), gasket 90 has the shape of a rectangular ring in the lateral-longitudinal (i.e., horizontal plane), and the gasket has a rectangular cross-section (FIG. 6) in the lateral-vertical and the longitudinal-vertical planes.

Gasket 90 contains adhesive material and is conveniently formed by die cutting the gasket from sheet fabric material impregnated with a thermosetting adhesive having "B" and "C" thermo-setting stages. Such adhesive may, for example but without restriction, be the adhesive which is sold under the brand name SEALID 964A by the Sealid Corporation, Moraga, Calif.

When gasket 90 is initially placed in its seat 35, the adhesive in the gasket is in stage "B" at which it is relatively tack-free and is in a solid or semi-solid condition at room temperature. For more details on the use as seals of die-cut gaskets impregnated with adhesive of such kind, reference is made to the article "High Performance B Stage Adhesives —Dry Processing" authored by Richard J. Ross and presented at the 28th National SAMPE Symposium, Apr. 12–14, 1983.

As shown in FIG. 6, when gasket 90 is placed on its seat 35 (FIG. 6), the inner rim of the gasket underlies and is in contact with the peripheral outer edge 89 of the chip-mounting plate 41.

Plate 41 has formed therein a vent hole 95 disposed between the edge 89 of the plate and the concavity 60 therein. Hole 95 extends vertically through plate 41 from upper acoustic cavity 24 to lower acoustic cavity 25 to effect equalization on the pressure of the air in those two cavities.

Coming now to the means for fastening together the top and bottom closures 12 and 13, such is accomplished by closure coupling means comprising parts which are integral with, respectively, the top closure and the bottom closure, and which are snap-fittable together to releasably lock the closures together. Such parts are as follows.

Top closure has on its front (FIG. 2) a pair of longitudinally spaced legs 101, 102 (FIG. 2) separated by a gap 100 and extending longitudinally downward from the top of the closure so that the lower parts of the legs overlap in the transverse or vertical dimension with the exterior of bottom closure 35 when device 10 is assembled (FIG. 1). The bottoms of legs 101, 102 are resiliently deflectable and those legs have thereon respective horizontal stubs 103, 104 projecting longitudinally outward from their legs in opposite directions from each other. Stubs 103, 104 have respective top latching faces 105, 106.

The elements 101–106 on the top closure 12 are adapted to cooperate with other elements formed on the exterior of the bottom closure 13, and which comprise: a central guide rib 107 having guide faces 108, 109 on longitudinally opposite sides thereof and slanting from its top downwardly and longitudinally outwards, two end guide ribs 110, 111 at longitudinally opposite ends of closure 13 and having respective guide and wedging faces 112, 113 slanting from the tops of such ribs downwardly and longitudinally inward, and a pair of catches 115, 116 disposed inward of and adjacent to, respectively, end ribs 110 and 111, and projecting laterally outward from the front side of closure 13. The catches 115, 116 have respective bottom latching faces 117, 118, and such catches also have respective wedging faces 119, 120 which slant from the catch tops downwardly and laterally outwards. End guide ribs 110, and 111 are undercut below their faces 112, 113 so as to have respective downward facing latching faces 121 and 122.

Figure 5:
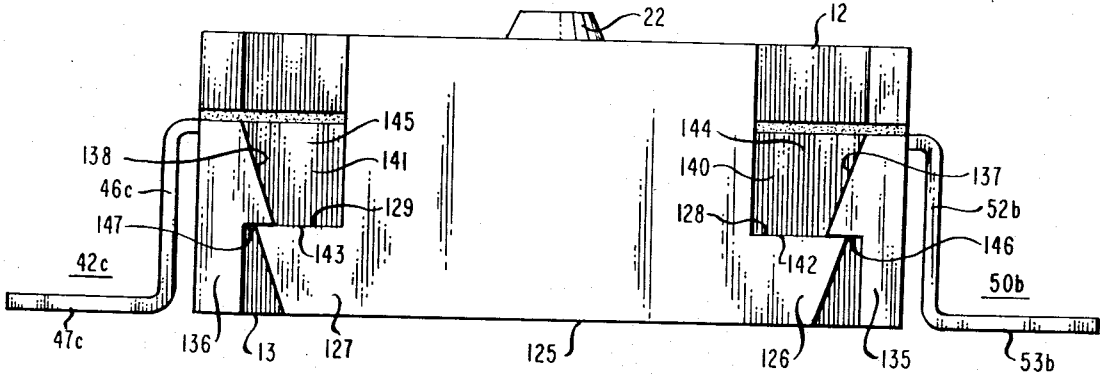
FIG. 5 is a back elevation view of the FIG. 1 device.

On its rear side the top closure 12 has (FIGS. 1, 2 and 5) a single wide leg 125 extending downward from the top of the closure to overlap in the vertical dimension with the exterior of bottom closure 13 when device 10 is assembled. Leg 125 is resiliently bowable and deflectable, and such leg at its bottom has two horizontal stubs 126 and 127 projecting therefrom in longitudinally opposite directions and carrying respective top latching faces 128 and 129. Elements 125–129 are adapted to cooperate with other elements formed on the exterior of bottom closure 13, and which comprise: a pair of end guide ribs 135, 136 at longitudinally opposite ends of the closure projecting laterally outward from the rear side thereof and having respective guide and wedging faces 137, 138 slanting from the rib tops downwardly and longitudinally inward, and a pair of catches 140, 141 projecting laterally outward from the rear side of closure 13 and disposed inward of and adjacent to the end ribs 135, 136. The catches 140, 141 have respective bottom latching faces 142, 143, and such catches also have respective wedging faces 144, 145 which slant from the catch tops downwardly and laterally outwards. End guide ribs 135 and 136 are undercut below their faces 137, 138 so as to have respective downward-facing latching faces 146 and 147.

Assembly and Use of the Embodiment

The device 10 may be assembled by the following steps as to which ones of them are not necessarily performed in the order in which they are described below.

Referring to FIG. 2, gasket 90 is placed in its seat 35 in bottom closure 13 to become seated therein. The bottom closure and the carrier strip 45 are then vertically displaced relative to each other to seat plate 41 of the sheet 40 over the lip 36 of the bottom closure and to cause the strips **42*a*, 42*b*, 42*c* to be received in, respectively, the grooves 43*a*, 43*b*, 43*c* in such closure, the lead 44 to be received in groove 46 of such closure, and the leads 50*a*, 50*b* to be received in the grooves 51*a*, 51*b* thereof with the heads 54*a*, 54*b* on such leads preventing their pulling out through such grooves. Before or after such seating of plate 41 over lip 36, the silicon micro-transmitter chip 70 is adhesively bonded to the planar bottom surface of concavity 60 in plate 41 by the layer 62 of epoxy resin deposited on that surface and surrounding hole 61. After chip 70 has so been bonded to plate 41, the terminals 81, 82 and 83 on the chip are connected by, respectively, wire conductors 84, 85 and 86 to, respectively, the lead 50*a*, the lead 50*b* and the lead 44**.

After device 10 has been assembled to the extent so far described, top closure 12 is pressed down on the aforedescribed assembly to drive its legs 101, 102 and 125 down over the outside of bottom closure 13. On the device's front side, the stubs 103, 104 bear, during such driving, against the wedging surfaces 112, 113 of end ribs 110, 111 to cause resilient longitudinally inward deflection of legs 101, 102 with accompanying longitudinally outward resilient displacement from each other of end ribs 110, 111 occurring as a result of longitudinal resilient stretching of the front side of closure 13, and the wedging faces 119, 120 of catches 115, 116 bear against the inner sides of those legs to resiliently deflect them laterally outward. Similarly, on the back side of device 10 (FIG. 5), the stubs 126, 127 salient from leg 125 bear, during such driving, against wedging surfaces 137, 138 of end ribs 135, 136 to cause resilient bowing of leg 125 in its longitudinal dimension with accompanying longitudinally outward resilient displacement from each other of end ribs 135, 136 occurring as a result of longitudinal resilient stretching of the back side of closure 13, faces 144, 145 of catches 140, 141 bear against the inner side of leg 125 to resiliently deflect it laterally outward.

The described deflections of legs 101, 102 and the resilient displacements of end ribs 110, 111 enables the latching faces 105, 106 on front legs 101, 102 to pass by the latching faces 117 and 118 on catches 115, 116 and the latching faces 121, 122 on the end guide ribs 110, 111. Similarly, the described bowing and deflection of back leg 125 and the resilient displacements of end ribs 135, 136 enables the latching faces 128, 129 on that leg to pass by the latching faces 142, 143 on catches 140, 141 and the latching faces 146, 147 on the end ribs 135, 136. Immediately, however, after the latching faces on the three legs pass by the associated latching faces on bottom closure 13, the legs disengage from the wedging surfaces on such closure, and the legs thereupon resiliently restore themselves by a snapping action to positions at which the resilient stress therein is relatively low, and at which the latching surfaces on the legs are beneath and in contact with the associated latching faces on closure 13 so as, by snap-fitting of such legs to the catches and end ribs on closure 13, to lock closures 12 and 13 together. To assure that the two closures have a tight snap-fit the latching faces on legs 101, 102, 125 are slightly beveled, and the associated latching faces on closure 13 are likewise slightly beveled to make flush contact with the leg latching faces contacted thereby. The beveling of the leg latching faces and of the closure latching faces imparts to each of such faces a slant of such character that the tendency of the legs to deflect to relieve remaining resilient stress therein will produce between the leg latching faces and the closure latching faces a wedging action, tending to draw top and bottom closures 12 and 13 together.

It follows that, when the two closures are snap-fitted together, the wedging action just described produces between the end surfaces 30 and 31 of closures 12 and 13 a maintained pressure engagement which eliminates play between such closures in the transverse dimension to thereby render such closures in mutually fixed relation in that dimension. Moreover, when closures 12 and 13 are snap-fitted together, central rib 107 on closure 13 fits with a close fit in gap 100 between legs 101 and 102 to eliminate any significant play in the longitudinal dimension between the two closures. Further, any significant play in the lateral dimension between closures 12 and 13 is eliminated by providing a close fit at the top of closure 13 between the inner sides of legs 101, 102 and 125 and the outer side walls registering therewith of the closure 13. Thus, and in contrast to many snap-fit couplings of two members together, the described snap-fit coupling of closures 12 and 13 serves to lock such two closures together in predeterminately fixed relation relative to each other in all three of the transverse, lateral and longitudinal dimensions. When such two closures are so predeterminately fixed relative to each other in all three of their translational coordinates, they are also predeterminately fixed relative to each other in all three of their angular coordinates. Such locking together of the two closures in such relation in all of their coordinates is advantageous from the acoustic viewpoint since it assures that the acoustic qualities of device 10 will not be degraded by misalignment of the acoustic cavities 24 and 25 of the device as a result of significant play between the closures 12 and 13 containing those cavities.

Another effect of the snap-fitting together of top and bottom closures 12 and 13 is to resiliently compress gasket 90 between, on the one hand the bounding wall of the "U" groove constituting gasket seat 35 and, on the other hand (a) the portions of the end surface 31 (FIG. 6) which are on laterally opposite sides of top closure 12 and which extend laterally inward of the end surface 31 of bottom closure 13, (b) the portions of elements 42*a*, 42*b*, 42*c*, 44 and 50*a*, 50*b* which overlie the gasket, and (c) the peripheral under edge 89 of plate 41. Still other effects of the snap-fitting together of closures 12 and 13 are that sheet 40 and leads 50*a*, 50*b* are incorporated into the assembly of device 10 so far formed, and of extensions 42 and 44 from plate 41 are held in the aperturing 43 and 46 in device housing 11 so that the portion of the sheet 40 within device housing 11 constitutes a beam supported at both of its ends by the housing to hold plate 41 and the chip 70 thereon positioned within the housing.

After snap-fitting together of the closures 12 and 13, the sheet 40 and the leads 50*a* and 50*b* are separated from stock strip 45 by severing leads 42*a*, 42*b*, 42*c* from carrier strip 45*b* at their junctures with that strip, and by severing leads 44 and 50*a*, 50*b* from carrier strip 45*a* at their junctures with that latter strip. The device 10 as so far fabricated is then heated to heat the adhesive with which gasket 90 is impregnated so that such adhesive by fusing and curing changes from stage "B" to stage "C", after which the device is cooled or allowed to cool back to room temperature. In the course of such heat treatment of the gasket, it becomes adhered both to the bounding wall surface of the rectangular U-shaped groove constituting gasket 35 and to the under peripheral edge 89 of plate 41 and the parts of elements 42*a*, 42*b*, 42*c*, 44 and 50*a*, 50*b* inside housing 11 and overlying the gasket. The gasket 90 thus adhesively bonds sheet 40 and leads 50*a*, 50*b* to bottom closure 13 so as to stabilize the positioning of each thereof inside housing 11 and to assure that those elements will remain with closure 13 when the two closures are separated. On the other hand, gasket 90 upon being heated and cured does not adhere strongly to the end surface 30 of upper closure 12. Accordingly closures 12 and 13 may be readily separated by prying the legs 101, 102, 125 of the upper closure away from their corresponding latching faces on the lower closure and, while such legs are so pried away, lifting the top closure off the bottom closure.

When gasket 90 has been placed and heated and cured as described above within the housing 11 formed by closure 12 and 13 as snap-fitted together, the gasket acts as an acoustic seal to isolate cavity 25 in bottom closure 13 from acoustic effects which might otherwise reach that cavity from cavity 24 in top closure 12 or by passage through the interface 20 between the two closures. While acting as such acoustic seal for cavity 24, gasket 90 also acts as an air seal therefor so as, in the absence of any other provision, to prevent equalization of the pressure of the air in, respectively, cavity 25 and cavity 24. In device 10, however, such pressure equalization is obtained, notwithstanding the air sealing effect of gasket 90, by the flow of air between the two cavities through vent hole 95.

Continuing with the assembly and fabrication of device 10, after the severance of sheet 40 and leads 50*a* and 50*b* from stock strip 45, and either before or after device 10 has subsequently been subjected to heat treatment to fuse and cure the adhesive in gasket 90, the parts outside housing 11 of the leads 42*a*, 42*b*, 42*c* are bent to form the aforedescribed downwardly extending arm portions 46*a*, 46*b*, 46*c* of those leads and the outwardly extending arm portions 47*a*, 47*b*, 47*c* thereof. Similarly the parts outside housing 11 of leads 44, 50*a* and 50*b* are bent to form the aforedescribed downwardly extending arm portions 38, 52*a*, 52*b* thereof and the outwardly extending arm portions 39, 53*a*, 53*b* thereof. When the assembly and fabrication of device 10 proceeds as described above, those bending actions complete the fabrication of the device.

The device 10 is put into use in a manner as follows. Referring to FIG. 1, the device is placed on a printing wiring board 150 so that the undersides of arm portions 47*a*, 47*b*, 47*c* of leads 42*a*, 42*b*, 42*c* make flush contact with metallic material on the board in the form of a metallic contact pad 151 and so that, concurrently, the undersides of arm portions 39, 53*a* and 53*b* of leads 44, 50*a* and 50*b* make flush contact with metallic material on the board in the form of other metallic contact pads 155, 156 and 157 on the board 150. The last named contact pads are each electrically isolated from the others in the sense of not being ohmically connected together, but contact pad 155 may physically be an extension of pad 151 and thus ohmically connected therewith. After the making of the flush contacts just described, each of elements 42*a*, 42*b*, 42*c*, 44 and 50*a*, 50*b* is bonded to the contact pad underlying it by well known surface mounting techniques so as to surface mount device 10 on board 150.

From the description just given, it will be realized that the sheet 40 (comprising elements 41, 42 and 44) as bonded to pads 151 and 155 performs the mechanical function of surface mounting device 10 on board 150, and that leads 50*a*, 50*b* as bonded to pads 156, 157 contribute to the performance of such mechanical function. Because the device 10 is bonded on both of its longitudinally opposite sides to board 150 by sheet 40 which passes as a strap continuously from one such side through the device's housing and then to the other such side, a strong, durable and reliable mechanical coupling is established between the device 10 and the board 150.

Electrically speaking, pads 151 and 155 are normally grounded. With plate 41 of sheet 40 being ohmically connected by leads 42 and 44 to those grounded pads, plate 41 performs the electrical function of providing a ground plane for the chip 70 mounted on the plate. Also, in such instance, the terminal 83 (FIG. 4) of chip 70 is ohmically connected through wire conductor 86 and lead 44 to pad 155 so as to be grounded. The other terminals 81 and 82 of chip 70 are connected through wire conductors 85 and 84 and leads 50*a*, 50*b* to ungrounded pads 156 and 157 to provide for communication through those pads between the electronics on the chip and circuitry exterior of device 10.

An application of device 10 is to place board 150 with device 10 surface mounted thereon in the transmitter section of a telephone handset and to utilize the capacitive microphone provided by the elements 73 and 77 of chip 70 as the transmitter of such handset. Device 10 has, however, other applications of which some are referred to in the aforementioned U.S. patent application Ser. No. 511,640.

The above disclosed embodiment being exemplary only, it is to be understood that additions thereto, omissions therefrom and modifications thereof can be made without departing from the spirit of the invention. Accordingly, the invention is not to be considered as limited save as is consonant with the scope of the following claims.

What is claimed is:

1. A transducer device comprising: a silicon microtransmitter chip, a housing for said chip comprising top and bottom transversely-displaced insulative closures having their front ends in registration at an interface between them in a transversely central region of said housing, and having respective acoustic cavities extending rearwardly thereinto from their front ends, said closures at their front ends having respective end surfaces facing towards each other and extending around the respective acoustic cavities formed in said closures and separated from each other by a discontinuity between them providing said interface between said closures, said top closure having a sound port formed in the top thereof to communicate with the cavity therein, chip-mounting means mounting said chip in said region in longitudinally and laterally centralized relation in said housing so that said chip is between said cavities, and closure coupling means comprising parts integral with, respectively, said top closure and bottom closure and snap-fittable together to lock said closures together in predetermined fixed relation and to cause said end surfaces to be in flush pressure engagement with each other at said interface when said closures are locked together by said closure coupling means.

2. A device according to claim 1 in which a first of said end surfaces of a first of said closures has aperturing to provide passage through such closure from the inside to the outside of said housing, and in which said chip-mounting means comprises a metallic sheet having, as integral parts thereof, a plate in said housing mounting said chip, and an extension part of said sheet extending longitudinally from one end of such plate, said extension part of said sheet being seated in said aperturing to hold said plate positioned in said housing.

3. A device according to claim 2 in which said extension part of said sheet passes through said aperturing to the outside of said housing and, outside it, is bent so as to comprise downwardly extending arm means and outwardly extending arm means of which the latter is adapted to be bonded to metallic material on a printed wiring board to surface mount said device on said board.

4. A device according to claim 3 in which said plate is adapted upon bonding of said downwardly extending arm means to said material to provide an electrical ground plane for said chip.

5. A device according to claim 3 in which said aperturing comprises a plurality of grooves formed in said first end surfaces, and in which said extension part of said sheet comprises a plurality of flat metal strips of which each passes through a respective one of said grooves.

6. A device according to claim 2 in which said plate part of said sheet is dished to form a central concavity in said plate, and in which said chip is seated in said concavity and is adhesively bonded to said plate.

7. A device according to claim 6 in which said plate has formed therein within said concavity a hole extending through said plate to acoustically couple said chip with the acoustic cavity in said bottom closure.

8. A device according to claim 2 in which said first closure has at its front end a gasket seat disposed inwardly of the front end surface of said first closure and extending around the front-end opening of the acoustic cavity formed in such closure, and in which said device further comprises a ring gasket seated on said seat so that the inner rim of said gasket underlies and contacts the outer edge of said plate.

9. A device according to claim 8 in which said gasket includes adhesive material by which said gasket is adhesively bonded both to said seat and to said outer edge of said plate so as to adhesively fasten said sheet to said first closure.

10. A device according to claim 8 in which said plate and chip cover the acoustic cavity in said first closure to provide a barrier to air flow between that cavity and the acoustic cavity in said second closure, and in which said plate has formed therein a vent hole disposed between said chip and the outer edge of said plate and adapted by air flow therethrough to equalize the respective air pressures in such two acoustic cavities.

11. A device according to claim 1 in which said closure coupling means comprises a plurality of outwardly deflectable resilient legs extending transversely from a first of said closures beyond the front end thereof to overlap with the outside of the second of said closures, and a plurality of catches on the outside of said second closure and adapted by snap-fitting with said legs to releasably lock such closures together in predetermined fixed relation.

12. A transducer device comprising, a silicon microtransmitter chip, a housing having a hollow interior and a transversely displaced top and bottom and having at its top a sound port permitting sound waves to enter said interior, said housing having in a transversely central region thereof and on one longitudinal side thereof a passage therethrough from the inside to the outside of said housing, and metallic sheet means extending through said passage so as to have a part inside and a part outside said housing, such inside part mounting said chip in said interior to be disposed between and in acoustic communication with upper and lower acoustic cavities provided by said interior, and said outside part of said sheet means being bent so as to comprise a downwardly extending arm portion and an outwardly extending arm portion of which the latter is adapted to be bonded to metallic material on a printed wiring board so as both to surface mount said device on said board and to provide an electrical ground plane for said chip.

13. A device according to claim 12 in which said housing has formed in the other longitudinal side thereof a plurality of passages extending therethrough from the inside to the outside of said housing, and in which said device further comprises a plurality of flat strip leads of which each extends through a respective one of said passages and has a part inside and a part outside said housing, and which the outside part of each such lead is bent to have a downwardly extending arm portion and an outwardly extending arm portion of which the latter is adapted to be bonded to metallic material on a said board to contribute to the surface mounting of said device thereon, said device further comprising a plurality of conductors in said interior and connecting the inside parts of said sheet means and said leads to terminals on said chip.

14. A surface mountable electronic component device comprising, an insulative housing for said device and having a top and a bottom, said housing have aperturing therein disposed intermediate its top and bottom and providing passage on longitudinally opposite sides of said housing between the inside and outside thereof, electronic means in said housing, and a longitudinally elongated metallic means extending through said aperturing to have a part thereof inside said housing and parts thereof disposed outside said housing on, respectively, one and the other of said longitudinally opposite sides of said housing, such outside parts being joined with said inside part in a continuous strap and being respectively shaped to be bondable to metallic material at respective longitudinally spaced locations on a printed wiring board to surface mount such device on such board.

15. A device according to claim 14 in which said inside part of said metallic means mounts said electronic means and is electrically connected thereto.

16. An electronic component device comprising, a housing for said device comprising top and bottom transversely displaced insulative closures having their front ends in registration at an interface between them, said closures on longitudinally opposite sides of said housing being non-overlapping with each other in the transverse direction, electronic means in said housing, a plurality of electrical leads electrically connected to such means on the inside of said housing and passing therethrough on longitudinally opposite sides thereof to the outside thereof, and separate closure coupling means on laterally opposite sides of said housing and each comprising a set of cooperable parts integral with, respectively, said top closure and bottom closure, at least one part in each of such sets being outwardly resiliently deflectable relative to the one of said closures with which such part is integral so as to cause the parts in each of such sets to be snap-fittable together to lock said closures together in predetermined fixed translational and angular relation relative to each other.

17. A device according to claim 16 in which said separate closure coupling means comprise first and second leg means integral with one of said closures and on laterally opposite sides thereof and extending transversely to overlap with the outside of the other of said closures in close laterally fitting relation therewith, first and second catch means integral with said other closure and on laterally opposite sides thereof and adapted by latching with, respectively, said first and second leg means to snap-fit said closures together so as to produce pressure engagement therebetween at their interface, and guide means integral with and on the outside of said other closure and cooperable with at least one of said first and second leg means to preclude significant longitudinal misalignment of said top and bottom closures when snap-fitted together.

* * * * *